US011359795B2

(12) United States Patent
Orsman et al.

(10) Patent No.: US 11,359,795 B2
(45) Date of Patent: Jun. 14, 2022

(54) COMPACT ADJUSTABLE LIGHTING SYSTEM

(71) Applicant: One Illuminates LLC, New York, NY (US)

(72) Inventors: Nathan Orsman, Watermill, NY (US); Robert Hoshlya, Wading River, NY (US)

(73) Assignee: One Illuminates LLC, New York, NY (US)

( * ) Notice: Subject to any disclaimer, the term of this patent is extended or adjusted under 35 U.S.C. 154(b) by 0 days.

(21) Appl. No.: 17/025,713

(22) Filed: Sep. 18, 2020

(65) Prior Publication Data

US 2022/0090763 A1 Mar. 24, 2022

(51) Int. Cl.

| | |
|---|---|
| ***F21V 14/02*** | (2006.01) |
| ***F21S 8/02*** | (2006.01) |
| ***F21V 23/00*** | (2015.01) |
| ***F21V 29/76*** | (2015.01) |
| *F21Y 115/10* | (2016.01) |

(52) U.S. Cl.

CPC ..... *F21V 14/02* (2013.01); *F21S 8/026* (2013.01); *F21V 23/009* (2013.01); *F21V 29/763* (2015.01); *F21Y 2115/10* (2016.08)

(58) Field of Classification Search

CPC ..... F21V 14/02; F21V 29/763; F21V 23/009; F21V 21/03; F21V 21/041; F21V 19/02; F21V 21/02; F21S 8/026; F21S 8/02; F21S 8/024; F21Y 2115/10

See application file for complete search history.

(56) References Cited

U.S. PATENT DOCUMENTS

| | | | | |
|---|---|---|---|---|
| 5,291,381 | A * | 3/1994 | Price | F21V 21/04 248/291.1 |
| 6,036,337 | A * | 3/2000 | Belter | F21S 8/02 362/257 |
| 8,708,522 | B2 * | 4/2014 | Wang | F21V 23/003 362/235 |
| 10,557,622 | B2 * | 2/2020 | Highbridge | F21V 23/003 |
| 2017/0184285 | A1 | 6/2017 | Visser et al. | |

(Continued)

FOREIGN PATENT DOCUMENTS

EP 1657486 A1 5/2006

OTHER PUBLICATIONS

Maxxima Style Factory Direct LED Lighting & Electrical; https://www.maxximastyle.com/recessed-lighting/6-inch-2700k-adjustable-slim-recessed-led-gimbal-downlight-canless-ic-rated-1000-lumens-warm-white-mrl-s61600w? gclid=Cj0KCQjw6uT4BRD5ARIsADwJQ1_Epic4inMz30H2PNY-uZlycY1ZqID44x9atLbBYn1QbKIGiiVfZqAaAn9dEALw_wcB (webpage accessed Sep. 23, 2020).

(Continued)

*Primary Examiner* — Bao Q Truong

(74) *Attorney, Agent, or Firm* — Ellenoff Grossman & Schole LLP; John C. Stellabotte

(57) ABSTRACT

The present invention generally relates to lighting systems, in particular, to adjustable down lights using an arc assembly and turntable component system providing a compact adjustable insulation contact (IC) light housing having the ability to adjust the direction of the light source, a field-swappable modular component system, and a modular trim system providing, in some scenarios, lighting flexibility and glare-free viewing angles.

17 Claims, 9 Drawing Sheets

(56) References Cited

U.S. PATENT DOCUMENTS

2019/0072258 A1 3/2019 Tan

OTHER PUBLICATIONS

RAB Adjustable Downlights; https://www.rablighting.com/feature/led-recessed-lighting-adjustable (webpage accessed Sep. 23, 2020).
International Search Report and Written Opinion for PCT Patent Application No. PCT/US2021/050942, dated Jan. 10, 2022.

* cited by examiner

COMPACT ADJUSTABLE LIGHTING SYSTEM

TECHNICAL FIELD

Various embodiments relate generally to lighting systems.

BACKGROUND OF THE INVENTION

In general, lighting systems, and specifically, downlight systems are configured to be recessed in a support structure, for example, a ceiling and are designed to shine a light down onto a space.

The downlights presently known in the art are large and bulky, difficult to install, and offer only one optic lighting choice which cannot be changed after the downlight has been installed. Moreover, such downlights typically take a significant amount of time to install, and are difficult to accommodate in smaller, urban-style builds. For example, the Adjustable Slim Recessed LED Gimbal Downlight (https://www.maxximastyle.com/recessed-lighting/6-inch-2700k-adjustable-slim-recessed-led-gimbal-downlight-can-less-ic-rated-1000-lumens-warm-white-mrl-s61600w?gclid=Cj0KCQjw6uT4BRD5ARIsADwJQ1_Epic4inMz30H2PNY-uZIycY1Zq1D44x9atLbBYn1QbKIGiiVfZqAaAn9dEALw_wcB) (hereinafter the "Gimbal Downlight") is a downlight lighting system which enables users to direct recessed ceiling lights up to 15 degrees in any direction. However, adjustment of the Gimbal Downlight can only be made outside of the housing of the fixture. The RAB Adjustable Downlight (https://www.rablighting.com/feature/led-recessed-lighting-adjustable) (hereinafter the "RAB Downlight") is another prior art approach that provides light angle and beam adjustability, however, the lighting module of the fixture is limited to 30 degree vertical adjustment, and requires manual adjustment outside the housing of the apparatus, in a fashion similar to that of the Gimbal Downlight.

In contrast to the downlight systems described herein, the downlight lighting apparatus of the present disclosure may be configured to enable the pivoting, rotation, and tilting of a light source within the downlight housing to provide a greater degree of adjustment. For example, the downlight lighting apparatus of the present disclosure may permit rotation over a range of 360 degrees, as well tilting adjustments over a range of 45 degrees in two directions. Therefore, in some scenarios, the downlight lighting system of the present disclosure may provide users with a greater range for adjustment of the lighting, and a larger light beam spread than the downlight lighting systems known in the art.

Moreover, in light of the limitations of the downlights presently known in the art, there is a need in the art for a lighting system which has, for example, the ability to be quickly installed and permits users to adjust the angle, position, location or direction of emitted light before, during and after installation of the lighting system as well as easily swap lighting optics at any time, as desired by a given user. These and other features and advantages of the present invention will become obvious to one skilled in the art through the summary of the invention that follows.

SUMMARY OF THE INVENTION

Apparatus and associated methods relate to a lighting system comprising a housing having an aperture extending towards a cavity, a lighting module, an adjustable arc assembly disposed in the cavity of the housing, connected to a bottom side of the housing and configured to adjustably receive the lighting module, a lighting driver assembly coupled to the housing and electronically connected to the lighting module, and a heat sink component. In some embodiments, the housing may have a top side opposing a bottom side, the bottom side having an aperture formed therein extending towards a cavity adapted to receive one or more lighting system components. In some examples, the adjustable arc assembly may comprise a rotatable arc component configured to adjustably connect to the lighting module and formed as a substantially concave structure having one or more platforms, and a turntable component operably connected to the rotatable arc component and configured to enable the arc component to rotate about a vertical axis of the housing. In some examples, the adjustable arc assembly may be configured to connect to the bottom side of the housing at one or more points. In some scenarios, the turntable component may be ring-shaped.

In one exemplary aspect, the present disclosure is directed to a lighting apparatus. In some embodiments, the lighting apparatus may include a housing having a cavity and comprising a top body shell and a bottom body shell, a lighting module assembly, an adjustable arc assembly, and a lighting driver assembly. In some examples, the device may include a heat sink assembly, a turntable component, one or more arm mounts, a mud plate and/or a trim assembly. In any embodiment, the lighting apparatus may include more or fewer components. One of ordinary skill in the art would appreciate that there are numerous configurations or number of components that might be used to form the device, and embodiments of the present invention are contemplated for use with any such configuration or number of components.

It is an object of the present invention to provide, in some examples, a lighting system providing immediate, tool-free, field-swappable optics, lighting modules, for example, LED modules, accessories and trims.

It is another object of the present invention to provide, in some examples, a downlight lighting system which permits users to adjust the direction, location, position or angle of emitted light before, during and after installation of the downlight lighting system.

It is another object of the present invention to provide, in some examples, a lighting system with a modular component system enabling field-swappable lighting computer chips, for example, LED computer chips and drivers.

It is another object of the present invention to provide, in some examples, a downlight system disposed in a compact housing.

It is another object of the present invention to provide, in some examples, a downlight system that is smaller than the downlights presently available in the art. For example, the downlight of the present disclosure may be fifteen percent smaller than the downlights of the prior art.

The foregoing summary of the present invention with the exemplary embodiments should not be construed to limit the scope of the invention. It should be understood and obvious to one skilled in the art that the examples of the invention thus described may be further modified without departing from the spirit and scope of the invention.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED SPECIFICATION

Figure 1:
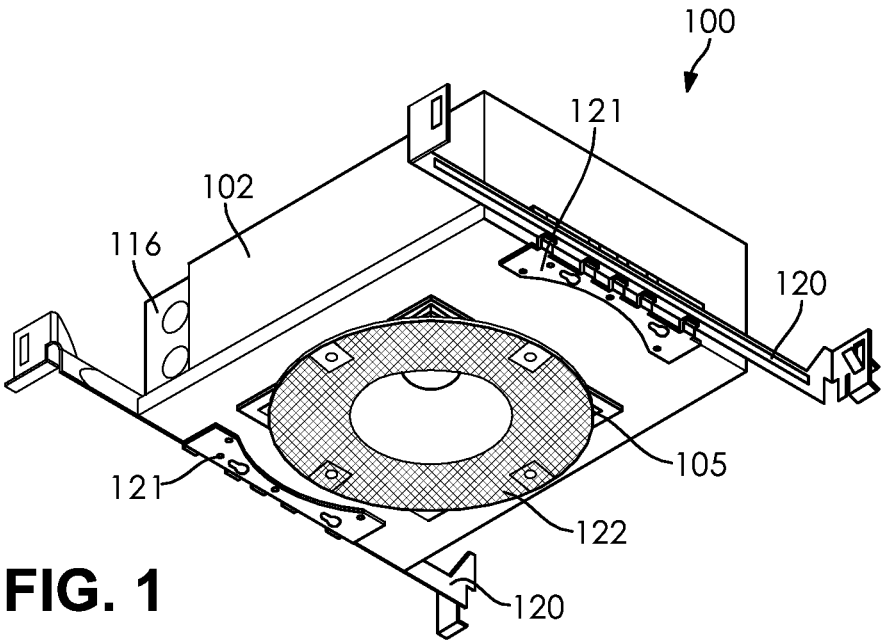
FIG. 1 shows a perspective view of an exemplary lighting assembly in accordance with embodiments of the present invention.

In the Summary above, the Detailed Description, the claims below, and in the accompanying drawings, reference is made to particular features (including method steps) of the present invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

In accordance with embodiments of the present invention, a lighting apparatus may include a housing having a cavity and comprising a top body shell and a bottom body shell, a lighting module assembly, an adjustable arc assembly, and a lighting driver assembly. In some examples, the device may include a heat sink assembly, a turntable component, one or more arm mounts, a mud plate and/or a trim assembly. In any embodiment, the lighting apparatus may include more or fewer components. One of ordinary skill in the art would appreciate that there are numerous configurations or number of components that might be used to form the device, and embodiments of the present invention are contemplated for use with any such configuration or number of components.

In accordance with embodiments of the present invention, the lighting system of the present disclosure may be configured for use in both residential and commercial settings. For example, the lighting system may be used in office spaces, elevator vestibules, vestibules in hotels or other hospitality locations, apartments, houses, development projects and art galleries.

In accordance with embodiments of the present invention, the lighting system, for example, the downlight system of the present disclosure, may be disposed in a compact housing. For example, the housing may be 3.5 inches or less in depth, 9.31 or less inches in length, and 12.39 inches in width. One of ordinary skill in the art would appreciate that there are numerous sizes or dimensions that might be used to form the housing of the lighting system, all without departing from the spirit and scope of the present invention.

In accordance with embodiments of the present invention, the bottom body shell may include an aperture or opening. The aperture or opening may be configured to allow light, for example, light emitted from an LED module, to pass outwards from inside the housing of the lighting system. In some examples, the aperture may be circular, however, the aperture may be formed in any suitable shape, for example, square, rectangular or hexagonal. In some scenarios, the aperture may have a diameter 4 inches in length. In some embodiments, the diameter of the aperture may be smaller, for example, the aperture may be 3.5 inches in length. One of ordinary skill in the art would appreciate that there are numerous shapes and sizes that might be used to form aperture of the lighting system, and embodiments of the present invention are contemplated for use with any such aperture shape or size.

In accordance with embodiments of the present invention, an exemplary adjustable arc assembly of the lighting system may be configured to permit the direction, position or angle of light emitted from a lighting module, for example, an LED module, connected to the arc component of the adjustable arc assembly to be adjusted along a dual axis before, during, or after installation of the lighting system. For example, the lighting module may be tilted 90 degrees along the arc component, or 45 degrees in at least two directions. Moreover, in some embodiments, the adjustable arc assembly may be configured to permit 360 degree rotation of a lighting module, for example, an LED module, connected to the arc component of the adjustable arc assembly. In some examples, the adjustable arc assembly may be configured to move the lighting module in 3-5 degree increments.

In accordance with embodiments of the present invention, adjustment of the adjustable arc assembly may be made manually, for example, by use of a user's hand, or automatically, for example, by use of an automated system. In some examples, the automated system may comprise a transmitter connected to the lighting system or lighting module via a communications means, for example, BluetTooth® technology, to enable remote monitoring or adjustment of the adjustable arc assembly, for example, to permit a user to adjust or change the degree of tilt or angle of the adjustable arc or the lighting module. In some scenarios, remote devices, for example, smartphones, tablets, or computers may be utilized to communicate with such a transmitter.

In accordance with embodiments of the present invention, the communications means of the system may be any means for communicating data, including image and video, over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any such communications means.

In accordance with embodiments of the present invention, an exemplary adjustable arc assembly of the lighting system may provide for infinite and tool free hot-aiming adjustability. In some examples, the adjustable arc may keep the lighting module, for example, the LED module centered on the housing aperture to permit a user to effortlessly fine tune the lighting experience.

In accordance with embodiments of the present invention, the lighting system may be compatible with a variety of trims. For example, the lighting system may be compatible with round, radius, square and snoot trim shapes. In any embodiment, the lighting system may be compatible with any sized or shaped trim. In some scenarios, the trims may be field changeable, for example, the trims may be easily changed even after installation of the lighting system. One of ordinary skill in the art would appreciate that there are numerous configurations or shapes that might be used to form trims of the lighting system, and embodiments of the present invention are contemplated for use with any such configuration or shape.

In accordance with embodiments of the present invention, the trims of the lighting system may be any size. In an exemplary embodiment, the size of a trim may be four inches. One of ordinary skill in the art would appreciate that there are numerous sizes that might be used to form trims of the lighting system, and embodiments of the present invention are contemplated for use with any such trim size.

In accordance with embodiments of the present invention, the lighting system may be compatible with a variety of lenses. In an exemplary embodiment, the lighting system is compatible with a solite lens. One of ordinary skill in the art would appreciate that there are numerous lenses that might be used with the lighting system, and embodiments of the present invention are contemplated for use with any such lens.

In accordance with embodiments of the present invention, the lighting system may include a light module, for example, an LED module, that is non-heat based.

In accordance with embodiments of the present invention, the lighting system may be designed in a variety of appearances. For example, the lighting system may be designed to have a flangeless, flanged, wood ceiling, or shower appearance. One of ordinary skill in the art would appreciate that there are numerous appearance designs for the lighting system, and embodiments of the present invention are contemplated for use with any such appearance design.

In accordance with embodiments of the present invention, the lighting system may include one of a variety of beam spreads. For example, the beam spread of the lighting system may be a 15 degree pin point beam spread, a 24 degree narrow beam spread, a 36 degree standard beam spread, or a 60 degree flood beam spread. One of ordinary skill in the art would appreciate that there are numerous beam spreads that may be utilized for the lighting system, and embodiments of the present invention are contemplated for use with any such beam spread.

In accordance with embodiments of the present invention, the lighting system of the present disclosure may be configured to accommodate a mudplate. In some examples, the mudplate may be 0.06 inches thick. In some embodiments, the thickness of the mudplate may assist users in easily and efficiently installing the lighting system housing, in that less mud compound is needed for installation. One of ordinary skill in the art would appreciate that there are numerous mudplate configurations and thicknesses, and embodiments of the present invention are contemplated for use with any such mudplate configuration or thickness.

In accordance with embodiments of the present invention, the lighting module, for example, an LED lighting module may be configured with a variety of color options. For example, an LED lighting module configured for use with the lighting system of the present disclosure may be set to constant color, dim to warm, circadian rhythm, or tunable color. In some scenarios, the LED lighting module may utilize releasable fasteners, for example, releasable pins which enable the optic options of the LED module to be interchangeable, even after installation. In any embodiment, the releasable fasteners may be any similarly suitable releasable fasters, for example, clips, screws or rivets.

Turning now to the figures, FIG. 1 shows a perspective view of an exemplary lighting assembly in accordance with embodiments of the present invention. As shown in FIG. 1, the lighting system 100 of the present disclosure may include a housing 102, a lighting driver assembly 116, bottom body shell aperture 105, a mudplate 122, one or more arm mounts 122, and one or more securing members 121.

Figure 2:
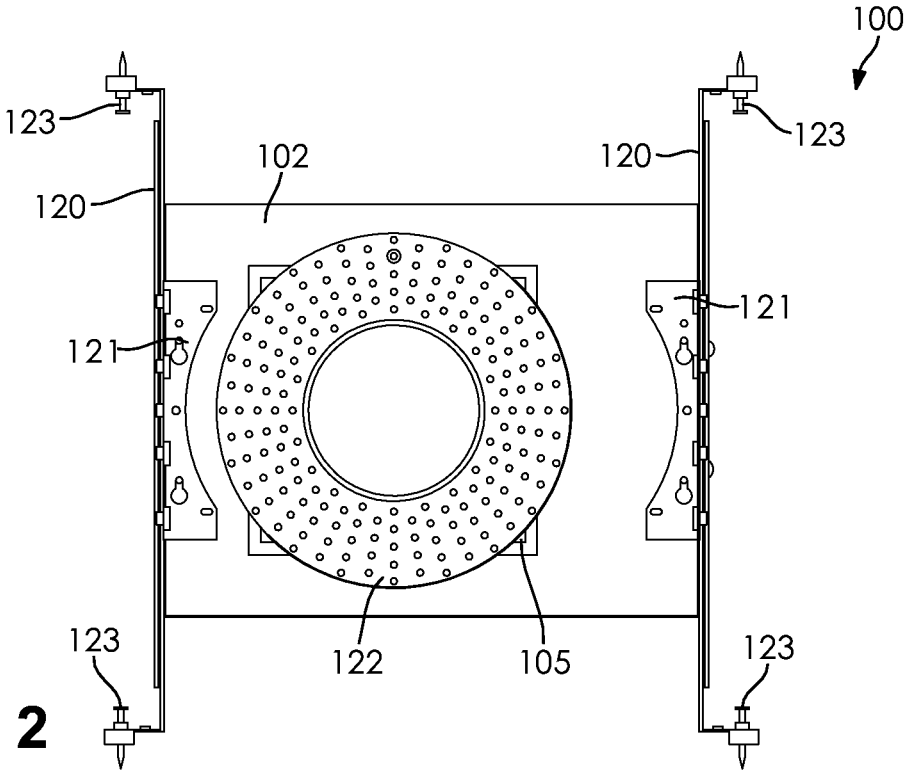
FIG. 2 shows a bottom view of an exemplary lighting assembly in accordance with embodiments of the present invention.

FIG. 2 shows a bottom view of an exemplary lighting assembly in accordance with embodiments of the present invention. As shown in FIG. 2, the lighting system 100 may comprise a housing 102 connected to one or more arm mounts 120 by one or more securing members 121. In some embodiments, the housing 102 includes an aperture 105 which extends towards an inner cavity, within which one or more components of the lighting system 100 may be disposed. In the depicted example, a mudplate 122 extends from and is operably connected to aperture 105. In some embodiments, one or more screw-type fasteners 123 may be utilized to secure the arm mounts 120 to a support structure, for example, a wall or ceiling. In any embodiment, any similarly suitable fasteners may be utilized to secure the arm mounts 120 to a support structure.

Figure 3:
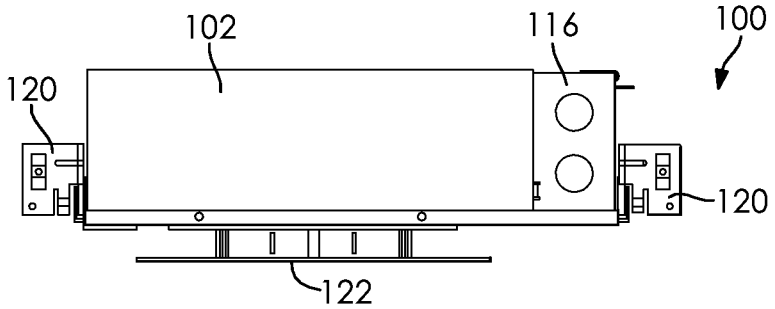
FIG. 3 shows a side view of an exemplary lighting assembly in accordance with embodiments of the present invention.

FIG. 3 shows a side view of an exemplary lighting assembly in accordance with embodiments of the present invention. As shown in FIG. 3, in some embodiments, a lighting driver assembly 116 may be configured to connect to the housing 102 of the lighting system 100. As shown in the depicted example, the arm mounts 120 may be configured to mount either or both of the housing 102 and the lighting driver assembly 116. Moreover, as shown in FIG. 3, the mudplate 122 may extend from the aperture (not shown) of the housing 102.

Figure 4:
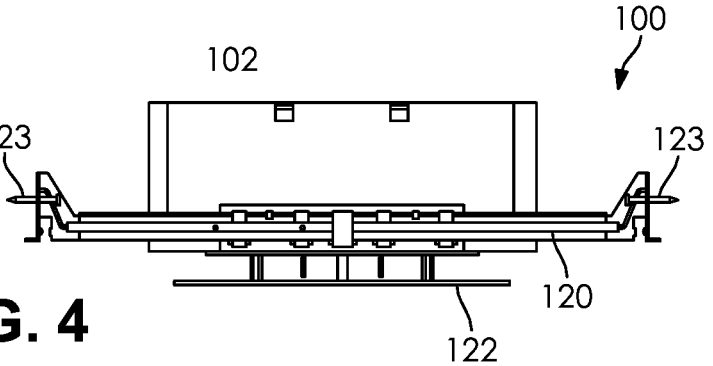
FIG. 4 shows a second side view of an exemplary lighting assembly in accordance with embodiments of the present invention.

FIG. 4 shows a second side view of an exemplary lighting assembly in accordance with embodiments of the present invention. As shown in the depicted example, arm mounts 120 may be configured to mount the housing 102 of the lighting system 100. Furthermore, one or more screw-type fasteners 123 may be utilized to connect the arm mounts 120 to a support structure. Moreover, as shown in FIG. 3, the mudplate 122 may extend from the aperture (not shown) of the housing 102.

Figure 5:
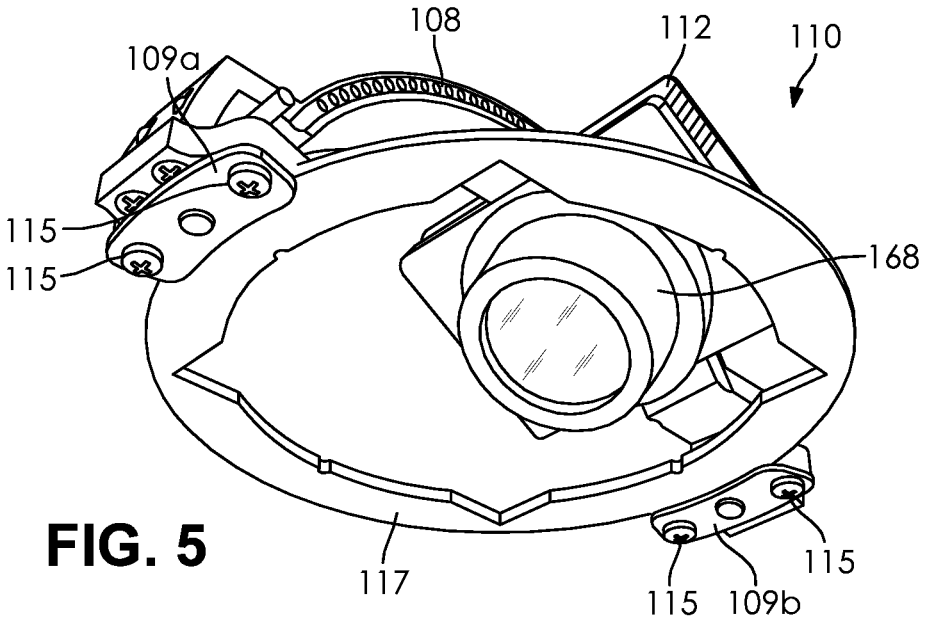
FIG. 5 shows a perspective view of an exemplary adjustable arc assembly in accordance with embodiments of the present invention.

FIG. 5 shows a perspective view of an exemplary adjustable arc assembly in accordance with embodiments of the present invention. As shown in FIG. 5, the adjustable arc assembly 110 may comprise an arc component 108 operably connected to a turntable component 117. In some embodiments, the arc component 108 is formed of aluminum. In any embodiment, the arc component 108 may be formed of any other similarly suitable metal material. In the depicted example, arc platforms 109*a* and 109*b* extending from the arc component 108 are configured to slidably engage with the turntable component 117 to permit rotation of the arc component 108 about the turntable component 117. In some examples, screw-type fasteners 115 may connect the arc platforms 109*a* and 109*b* to the arc component 108. As further shown in FIG. 5, a lighting module assembly 112 may be operably connected to the arc component 108. The lighting module assembly may include an optic holder 168. The angle and position of the optic holder 168 may be adjusted to direct the light at different angles.

Figure 6:
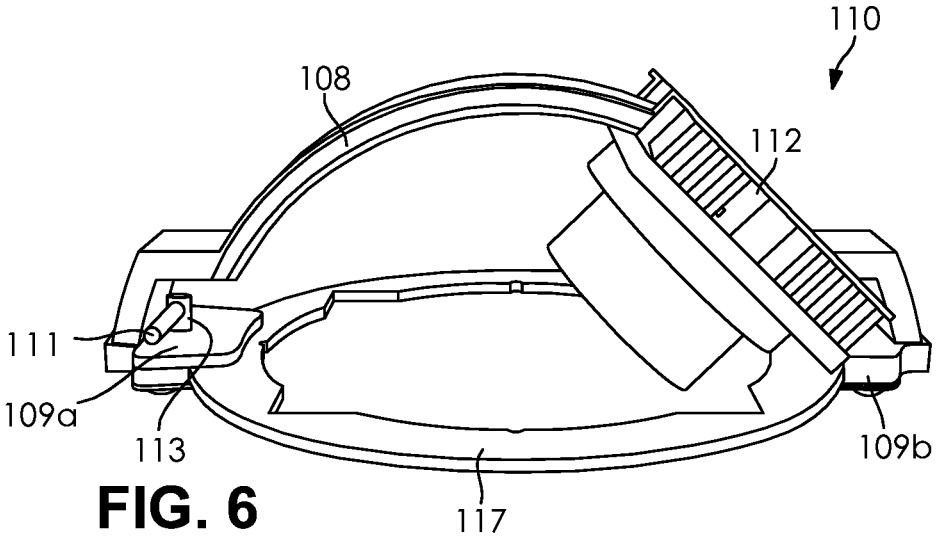
FIG. 6 shows a side view of an exemplary adjustable arc assembly in accordance with embodiments of the present invention.

FIG. 6 shows a side view of an exemplary adjustable arc assembly in accordance with embodiments of the present invention. As shown in FIG. 6, the lighting module assembly 112 may be operably connected to the arc component 108 so that the lighting module assembly 112 can be positioned at different positions along the arc component 108 to adjust the position of the lighting module assembly 112 and the light coming from the lighting module assembly 112. In some embodiments, the lighting module assembly may be configured to slidably engage with the arc component 108. In some embodiments, the arc platforms 109*a* and 109*b* are configured to slidably engage with the turntable component 117. In some embodiments, one or more rotation locking elements may be utilized to selectively lock the arc component 108 along the turntable component 117 in a user selected position. As shown in the depicted example, in some scenarios, the locking elements are cam locks 113 adapted to engage with cam handles 111.

Figure 7:
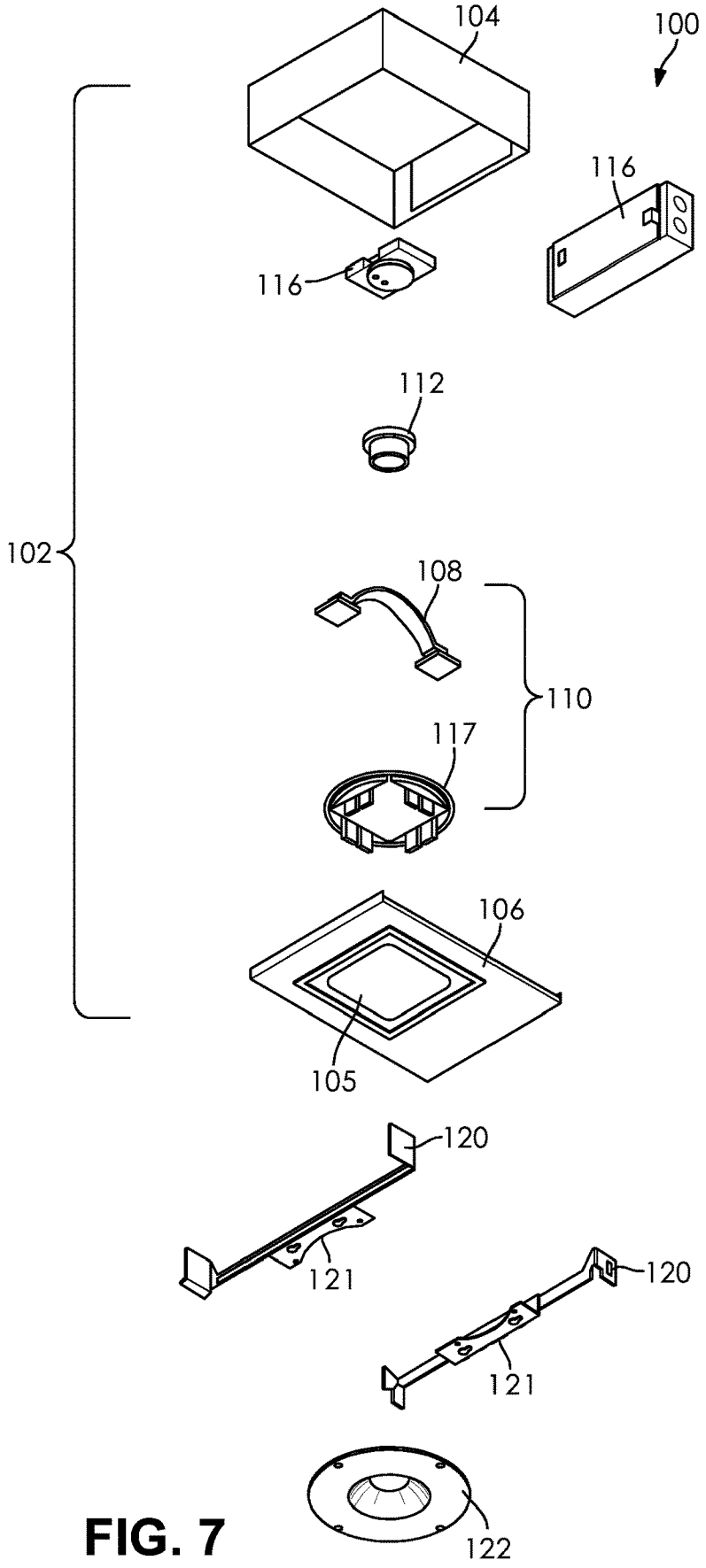
FIG. 7 shows an exploded view of an exemplary lighting assembly in accordance with embodiments of the present invention.

FIG. 7 shows an exploded view of an exemplary lighting assembly in accordance with embodiments of the present invention. As shown in FIG. 7, the lighting system 100 of the present disclosure may include a housing 102 comprising cavity 103 and a top body shell 104 opposing a bottom body shell 106. In some embodiments, the housing 102 may be configured to receive a lighting driver assembly 116, a heat sink assembly 151, a lighting module assembly 112 and an adjustable arc assembly 110. In some examples, the housing may include a removable housing cover. In some embodiments, the lighting system 100 may include one or more arm mounts 120. In some examples, the lighting system 100 includes a mudplate 122 and a trim 125.

Figure 8:
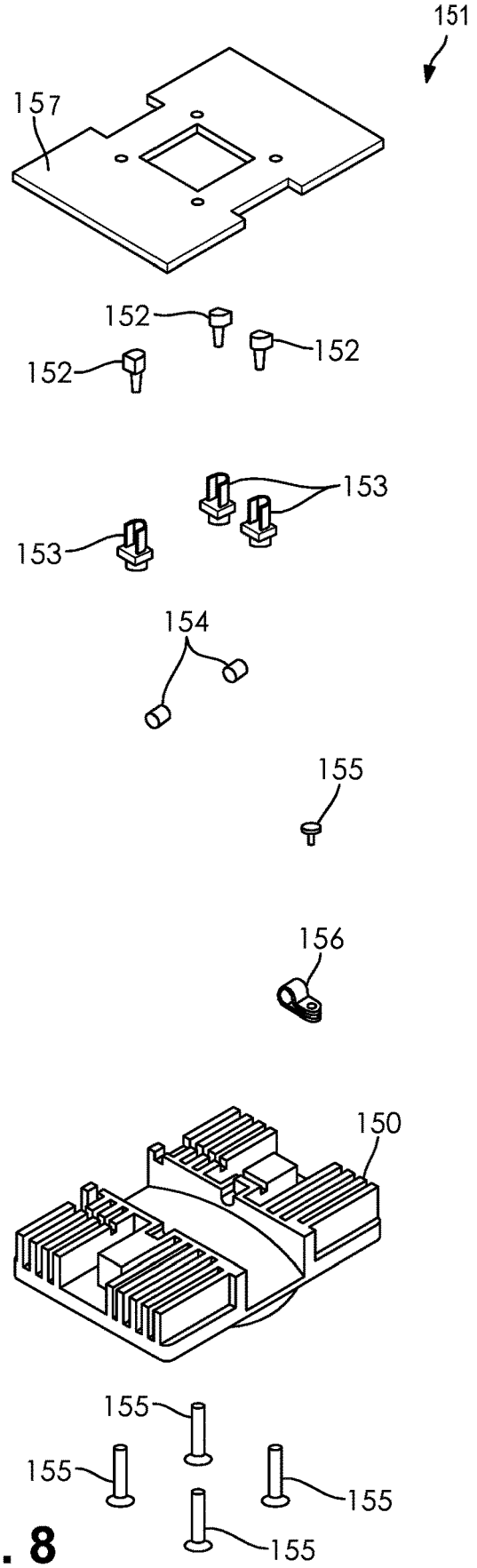
FIG. 8 shows an exploded view of an exemplary heat sink assembly in accordance with an embodiment of the present invention.

FIG. 8 shows an exploded view of an exemplary heat sink assembly in accordance with an embodiment of the present invention. As shown in FIG. 8, the heat sink assembly 151 may comprise a top plate 157, one or more pin connections 152, one or more pin holders 153, one or more ball catches 154, one or more screw-type fasteners 155, a power cable holder 156, and a heat sink 150. In some embodiments, one or more of the heat sink components may be interchangeable. In some scenarios, one or more of the heat sink components fasten directly to the heat sink 150. For example, one or more of the heat sink components may fasten to the heat sink 150 via tapped and threaded fasteners, for example, tapped and threaded studs, and pin connections 152. In some examples, the tapped and threaded fasteners, the pin connections 152, or both, may provide easy connection of the heat sink assembly 151 to the lighting module assembly 112. For example, the tapped and threaded fasteners, the pin connections 152, or both, may provide easy "plug and play" connection capabilities for releasable connection of the heat sink assembly 151 to the lighting module assembly 112, for example, to swap color temperature and optic beam spread in a tool-free manner, which may be achievable in the field with hot-aiming. The heat sink 150 may be configured as a passive heat exchanger that transfers the heat generated by an electronic or a mechanical device to a fluid medium, for example, air or a liquid coolant, such that the heat is dissipated away from the lighting system 100, thereby allowing regulation of the system's temperature. In some embodiments, the heat sink assembly 151 may be configured to come in direct or indirect contact with the arc component 108. In some scenarios, direct contact between the heat sink assembly 151 and the arc component 108 permits the arc component 108, which may be formed of aluminum metal, to act in concert with the heat sink assembly 151 to assist in the heat dissipation process. In some examples, the configuration of the heat sink assembly 151 permits the heat sink assembly 151 to be shallow, for example, shallower than heat sinks presently known in the art, which in turn permits the housing 102 to be shallow, for example, shallower than downlight housings presently known in the art. As shown in the illustrated example, the heat sink assembly 151 may be configured to have a rectilinear orientation. Moreover, the heat sink assembly 151 may comprise a plurality of straight fins, wherein one or more ducts oriented lengthwise optimize the depth of the heat sink assembly 151. In some embodiments, the orientation of the straight fins maximizes the surface area and air flow volume of the heat sink assembly 151. Thus, as shown in the depicted example, the heat sink assembly 151 may be configured to be short and wide, when compared to traditional heat sinks. In some embodiments, the heat sink assembly 151 may draw heat outward or downward, for example, towards the bottom body shell of the heat sink, as opposed to upwards, which may further permit the heat sink assembly 151 and housing 102 to be relatively shallow, for example, shallower, than the downlight heat sinks and housings presently known in the art, as the heat sink assembly 151 would not require open space above the heat sink 150 to dissipate heat. Instead, the heat may be drawn outward or downward, with assistance from the arc component 108, towards the open space in the housing 102, for example, the cavity 103 or the bottom body shell aperture 105. Moreover, in some embodiments, the heat sink assembly 151 may be configured to draw heat away from the lighting module assembly 112 and into open air space inside the length of the housing, which may create a convection cooling effect. In any embodiment, the heat sink assembly 151 may include more or fewer components. One of ordinary skill in the art would appreciate that there are numerous configurations or number of components that might be used to form the heat sink, and embodiments of the present invention are contemplated for use with any such configuration or number of components.

Figure 9:
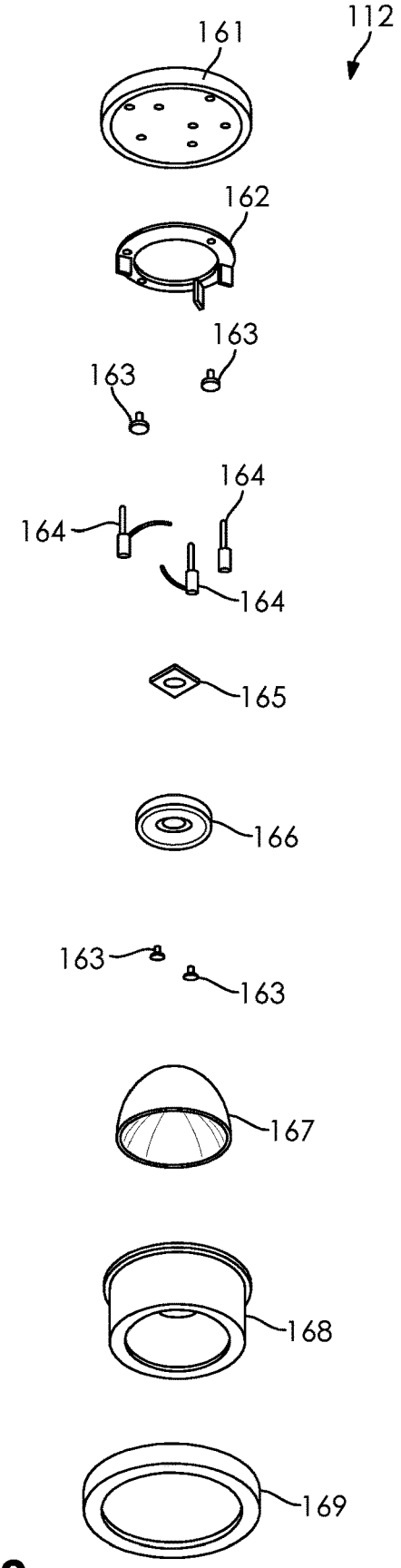
FIG. 9 shows an exploded view of an exemplary lighting module assembly in accordance with embodiments of the present invention.

FIG. 9 shows an exploded view of an exemplary lighting module assembly in accordance with embodiments of the present invention. In some embodiments, the lighting module assembly 112 is configured as an LED module assembly. The lighting module 112 may be configured to engage with or connect to the adjustable arc assembly 110. As shown in FIG. 9, the lighting module assembly 112 may comprise a lighting module base 161, a ring component 162, one or more screws 163, one or more releasable fasteners, for example, releasable pin connectors 164, a lighting diode or chip 165, for example, an LED chip, a chip holder 166, an optic lens 167, an optic holder 168, and a lighting module holder 169. In any embodiment, the screws 163 may be replaced with any similarly suitable fasteners, for example, bolts, rivets or pins. In some embodiments, the lighting module assembly 112 may include a quick connect system for power cables that can be quickly and/or easily deployed. For example, the lighting module assembly 112 may utilize "plug and play" connectors which may permit users to separate the lighting module driver from the light source quickly and/or easily. In some embodiments, the lighting chip 165 may be mounted to metal plates, for example, flat aluminum plates, which may be configured to sandwich the arc component 108 and permit the movement of the lighting module 112 along the arc component 108, for example, 45 degrees from the center of the arc component 108 in either direction. In some embodiments, the lighting module 112 may be configured to engage with a position stabilizer configured to couple the lighting module 112 to the arc component 108, for example, by means of compression coupling. In such embodiments, the position stabilizer may be configured to lock the lighting module 112 along the arc component 108 in a range of user selected positions. In any embodiment, the lighting module assembly 112 may include more or fewer components. One of ordinary skill in the art would appreciate that there are numerous configurations or number of components that might be used to form the lighting module assembly, and embodiments of the present invention are contemplated for use with any such configuration or number of components.

Figure 10:
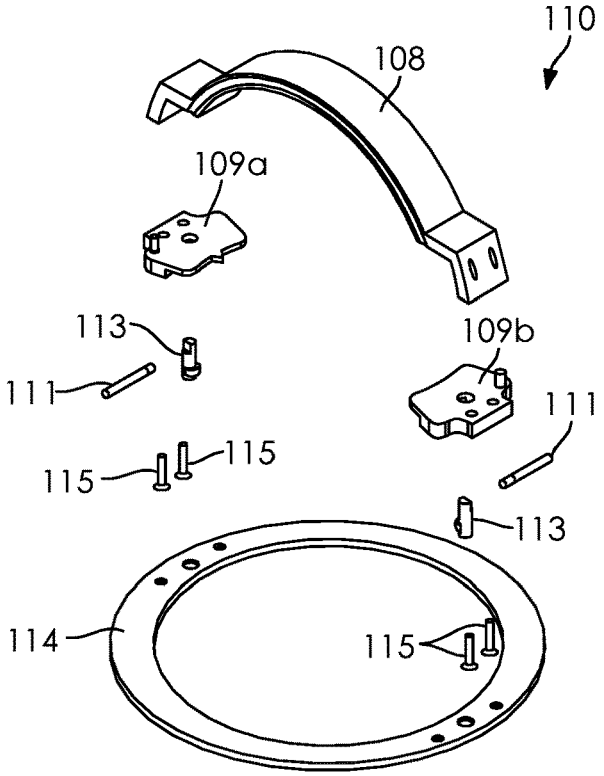
FIG. 10 shows an exploded view of an exemplary adjustable arc assembly in accordance with embodiments of the present invention.

FIG. 10 shows an exploded view of an exemplary adjustable arc assembly in accordance with embodiments of the present invention. As shown in FIG. 10, the adjustable arc assembly 110 may comprise an arc component 108, one or more arc platforms 109, one or more cam locks 113, one or more cam handles 111, one or more screws 115, and an arc base component 114. In any embodiment, the screws 115 may be replaced with any similarly suitable fasteners, for example, bolts, rivets or pins. In some embodiments, for example, as shown in the depicted example, the arc platforms 109 may connect to the bottom edges of arc component 108. In some embodiments, the platforms 109 may be integrally formed with the arc component 108. In the illustrated example, the adjustable arc assembly 110 comprises a first arc platform 109*a* and a second arc platform 109*b*. In some embodiments, the arc component 108 is configured in a substantially concave or semi-circular structure or configuration. In some embodiments, the arc base component 114 is circular or round. In some embodiments, the arc component 108 is configured to operably connect to the turntable component 117. In some embodiments, the arc component 108 is configured to rotate 360 degrees relative to the housing 102. For example, the arc component 108 may rotate 360 degrees, in 1, 5, or 10 or more degree increments, relative to the housing 102. In some scenarios, the arc component 108 connects to the turntable component 117 in a manner that permits the arc component 108 to rotate 360 degrees along or about the turntable component 117. For example, the arc platforms 109*a* and 109*b* operably connected to or extending from the arc component 108 may be configured to engage with the outer surface or circumference of the turntable component 117 to permit the rotation of the arc component 108 along the turntable component 117 such that the arc component 108 is able to rotate about a vertical axis of the housing 102. In some examples, the arc base component 114 is configured to stabilize or balance the position of the arc component 108. In some embodiments, one or more rotation locking elements may be utilized to selectively lock the arc component 108 along the turntable component 117 in a user selected position. In some scenarios, the locking elements are cam locks 113 adapted to engage with cam handles 111. One of ordinary skill in the art would appreciate that there are numerous configurations or number of components that might be used to form the adjustable arc assembly, and embodiments of the present invention are contemplated for use with any such configuration or number of components.

Figure 11:
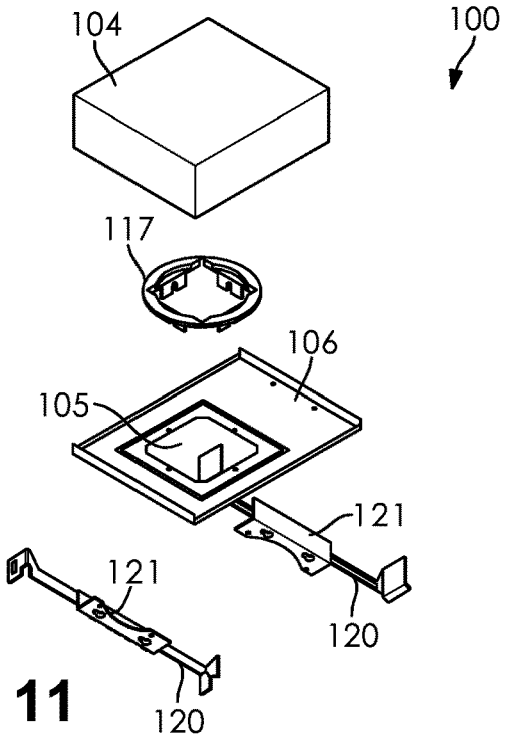
FIG. 11 shows an exploded view of a lighting system housing in accordance with an embodiment of the present invention.

FIG. 11 shows an exploded view of a lighting system housing in accordance with an embodiment of the present invention. As shown in FIG. 11, the lighting system housing 102 may comprise a top body shell 104 opposing a bottom body shell 106. In some embodiments, the housing may include a cavity 103 configured to house one or more lighting components. In the depicted example, a turntable component 117 is configured to operably connect to the bottom body shell 106 at the bottom body shell aperture 105. In some embodiments, the housing 102 may operably connect to one or more arm mounts 120. In some embodiments, one or more securing members 121, for example, brackets, may be used to fasten the arm mounts 120 to the housing 102. The arm mounts 120 may be configured to mount the housing 102 to a support structure, for example, a wall or ceiling. In some examples, one or more screw-type fasteners 123 or any other similarly suitable fasteners may be used to mount the arm mounts 120 to a support structure. The arm mounts 120 may be adjustable, for example, the arm mounts 120 may comprise telescoping components configured to permit adjustment of the length of the arm mounts 120. In the depicted example, two arm mounts 120 are shown for mounting the housing 102 to a support structure.

Figure 12:
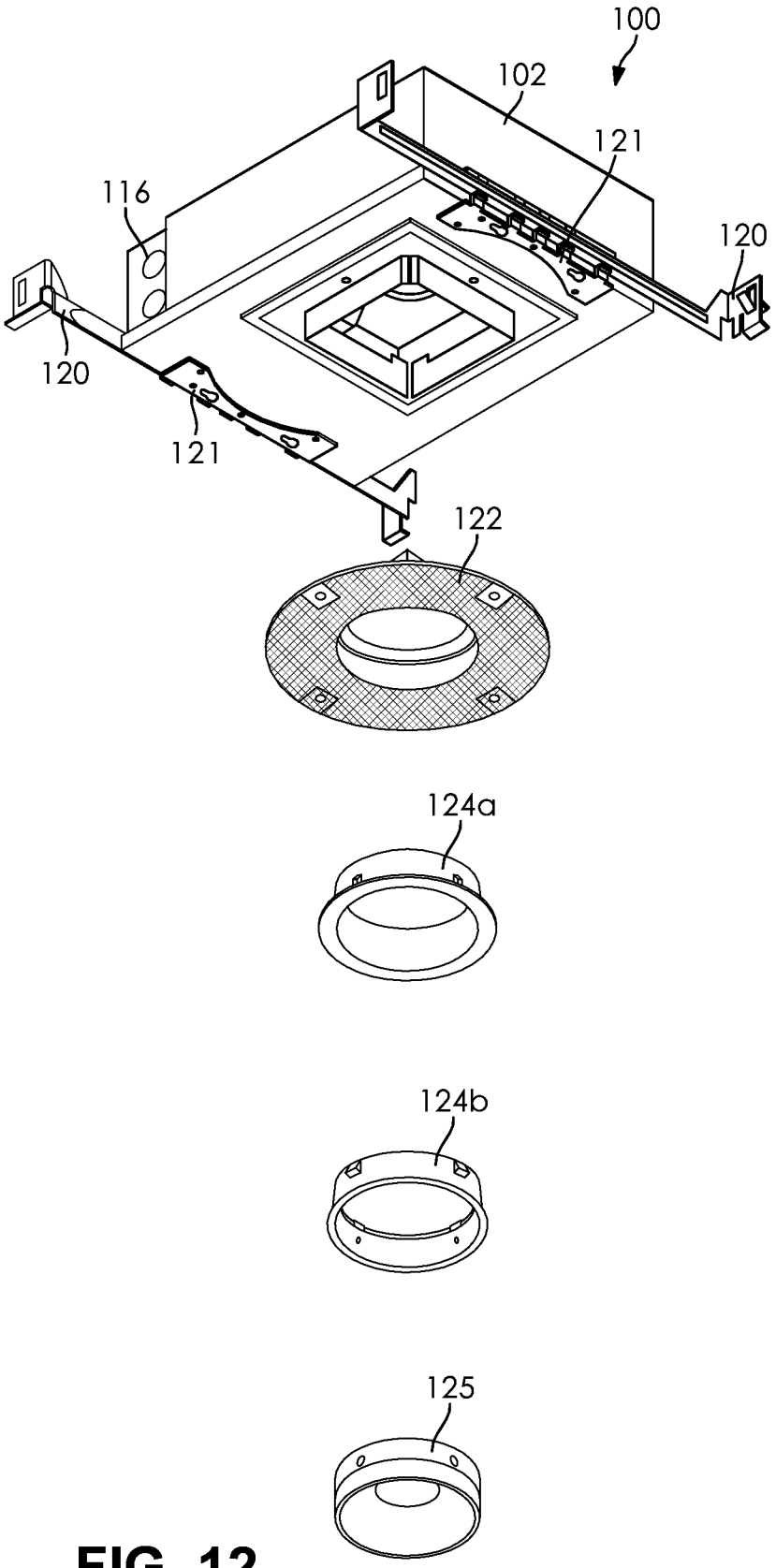
FIG. 12 shows an exploded view of an exemplary trim assembly of an exemplary lighting system in accordance with embodiments of the present invention.

FIG. 12 shows an exploded view of an exemplary trim assembly in accordance with embodiments of the present invention. As shown in FIG. 6, a trim assembly may include a mudplate 122, a trim adapter 124*a*, a ceiling adapter 124*b*, and a trim 125. As shown in the depicted example, the trim assembly may be configured to connect to the housing 102 of the lighting system 100.

Figure 13A:
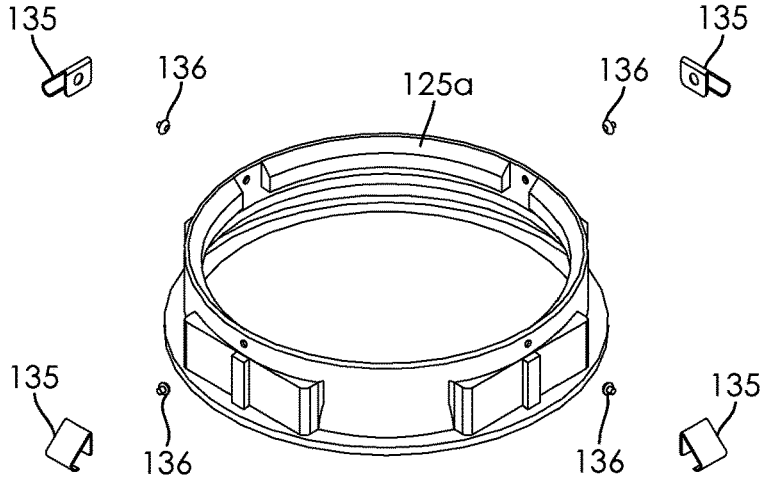
FIG. 13*a* shows an exploded view of an exemplary circular trim assembly in accordance with embodiments of the present invention.
Figure 13B:
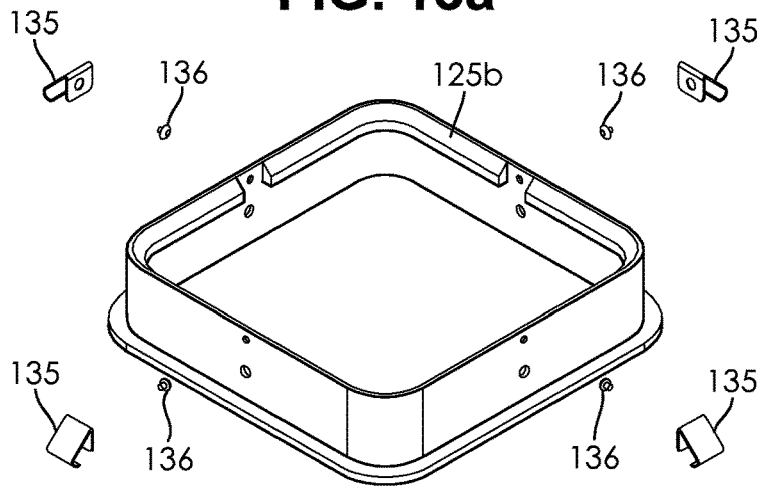
FIG. 13*b* shows an exploded view of an exemplary square trim assembly with rounded edges in accordance with embodiments of the present invention.
Figure 13C:
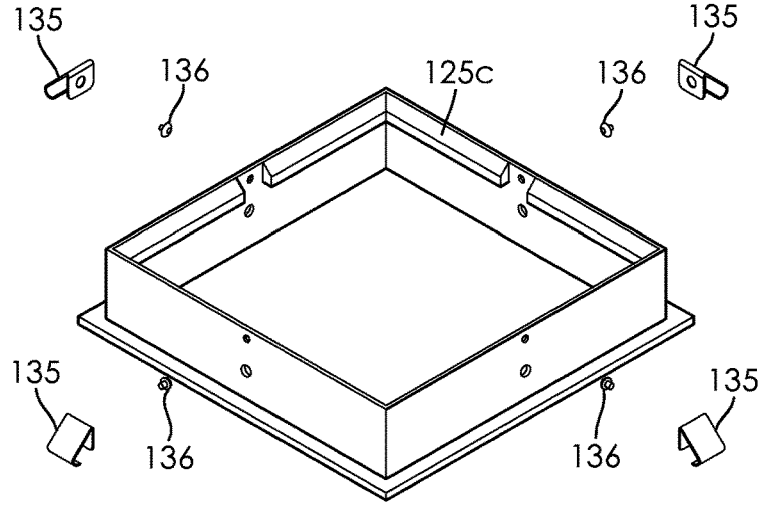
FIG. 13*c* shows an exploded view of an exemplary square trim assembly with pointed edges in accordance with embodiments of the present invention.

As shown in FIGS. 13*a*-13*c*, the lighting system 100 of the present disclosure may be compatible with trims of various shapes and sizes. For example, circular trims 125*a* (as shown in FIG. 13*a*), square trims with round edges 125*b* (as shown in FIG. 13*b*), and square trims with pointed edges 125*c* (as shown in FIG. 13*c*). As shown in FIGS. 13*a*-13*c*, clips 135 and fastening pins 136 may be used to secure the trims 125 to the housing 102. In any embodiment, any similarly suitable fasteners may be used to secure the trims 125 to the housing 102.

Figure 14:
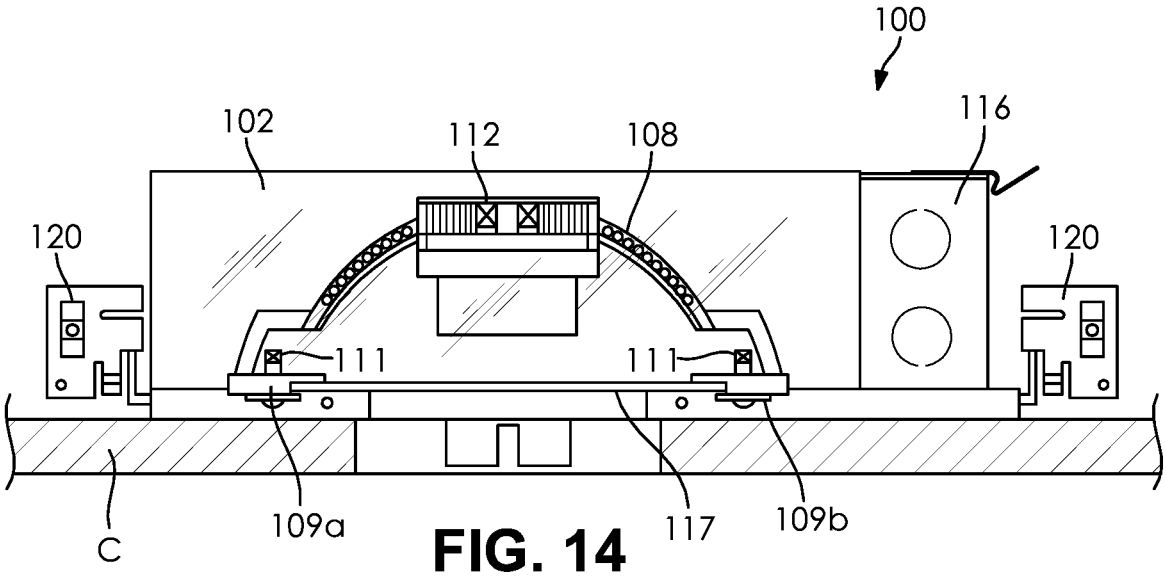
FIG. 14 shows a first cross-sectional of an exemplary lighting assembly in accordance with embodiments of the present invention.

FIG. 14 shows a cross-sectional of an exemplary lighting assembly in accordance with embodiments of the present invention. As shown in FIG. 14, the arc component 108 may be disposed within the cavity of the lighting system housing 102 and the lighting module 112 may be adjustably connected to the arc component 108. As shown in the illustrated example, the lighting system 100 may be installed within a support structure, for example, a ceiling C through the use of wall mounts 120. As shown in the depicted example, in some embodiments, the lighting driver assembly 116 may connect to the lighting system housing 102. In some examples, the arc component 108, and the lighting module assembly 112 disposed thereon may be configured to rotate about the turntable component 117 on a vertical axis relative to the lighting system housing 102. In some embodiments, one or more rotation locking elements may be utilized to selectively lock the arc component 108 along the turntable component 117 in a user selected position. As shown in the depicted example, in some scenarios, the locking elements are cam locks 113 adapted to engage with cam handles 111.

In accordance with an exemplary usage scenario, the lighting module holder 169 within the housing 102 may be removed, for example, unscrewed, such that the lighting module 112 may be placed (or replaced). The lighting system 100 may then be installed by connecting the lighting system housing 102 to one or more arm mounts 120. In some examples, the arm mounts 120 may be utilized to mount the housing 102 to a support structure, for example, one or more ceiling joists disposed in a ceiling. The housing cover 121 may be removed, for example, by releasing fasteners, for example, clips disposed on the housing cover 121. Next, conduit or Romex wires may be connected through a knock-out in the housing 102 using appropriate connectors, for example, connectors of the appropriate wire and conduit size. The housing cover 121 may be shut or closed using the fasteners (e.g. clips) once the wire connections are secured. Next, at the option of a user, drywall may be installed around the housing 102 of the lighting system 100.

Figure 15:
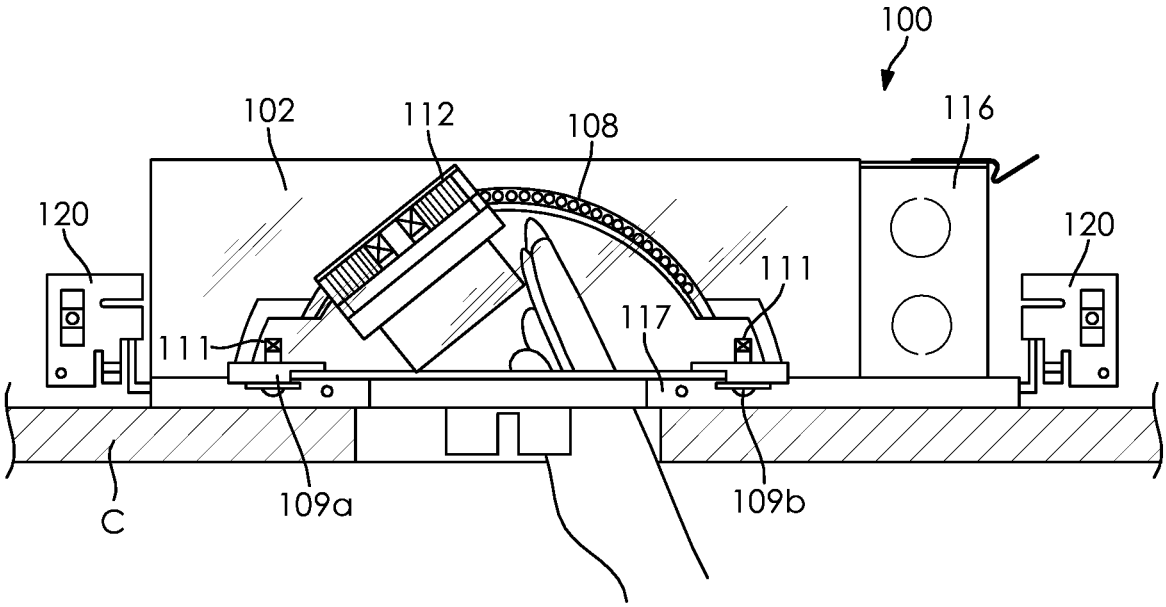
FIG. 15 shows a second cross-sectional of an exemplary lighting assembly, demonstrating use of the device, in accordance with embodiments of the present invention.

FIG. 15 shows a cross-sectional of an exemplary lighting assembly, demonstrating use of the device, in accordance with embodiments of the present invention. In accordance with an exemplary usage scenario, the adjustable arc assembly 110 may be adjusted by a user. For example, a user's hand may be used to manually tilt the lighting module 112 disposed on the arc component 108 of the arc assembly 110, and/or to rotate the arc component 108 along the turntable component 117. The light emitted from the lighting assembly 100 may thus be oriented to a user's desired angle, direction, position or location. In some scenarios, the user-selected lighting angle may reduce glare. At the option of the user, the adjustment arc assembly 110 may be locked into a particular rotated position using the cam locks 113 and cam handles 111 disposed on the arc platforms 109*a* and 109*b*. In some scenarios, the lighting module 112 may then be tilted along the arc component 108 to a degree and locked in place, as desired by a user.

In some scenarios, a mudplate 122 may be installed over the aperture or opening 105 of the housing 102, for example, by inserting the mudplate 122 into the turntable component 117. A dust cover, for example, a clear plastic dust cover, may then be inserted into the mudplate 122 opening. A user may then finish the ceiling to a desired effect and may remove the dust cover in order to install a desired trim 125 into the mudplate opening 122.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;", or, through the use of any of the phrases: "in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments, elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of" or "consisting of." In the present disclosure, any method or apparatus embodiment may be devoid of one or more process steps or components. In the present disclosure, embodiments employing negative limitations are expressly disclosed and considered a part of this disclosure.

The term "comprises" and grammatical equivalents thereof are used herein to mean that other components, ingredients, steps, among others, are optionally present. For example, an embodiment "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f).

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A down lighting apparatus, comprising:
- a housing having an aperture extending towards a cavity;
- a lighting module comprising an optic holder and a down light;
- an adjustable arc assembly disposed in the cavity of the housing, connected to a bottom side of the housing and comprising,
  - a turntable component formed in the shape of a ring; and
  - an arc component formed in the shape of a semi-circle and having two end portions operably connected to the turntable component at two points and rotatable about a vertical axis of the housing, wherein the lighting module slides along the arc component to move from a first position to a second position;
- a lighting driver assembly coupled to the housing and electronically connected to the lighting module; and
- a heat sink component.

2. The lighting apparatus of claim 1, wherein an angle and direction of the optic holder can be adjusted and the position of the lighting module can be adjusted along the arc component.

3. The lighting apparatus of claim 1, wherein the heat sink component comprises a plurality of straight fins.

4. A lighting apparatus, comprising:
- a housing having an aperture extending towards a cavity;
- a lighting module comprising an optic holder and a down light;
- an adjustable arc assembly disposed within the housing cavity and connected at one or more points to a bottom side of the housing, comprising:
  - a turntable component formed in the shape of a ring; and
  - a curved arc component formed as a semi-circular structure and having two end portions operably connected to the turnable component at two points and rotatable about a vertical axis of the housing, wherein the lighting module is positionable along the arc component 45 degrees in two directions from a central axis of the housing;
- a lighting driver assembly coupled to the housing and electronically connected to said lighting module; and
- a heat sink component.

5. The lighting apparatus of claim 4, wherein the adjustable arc assembly further comprises one or more rotation locking elements configured to selectively lock the arc component along the turntable component about a vertical axis of the housing at one or more user selected positions a range of 360 degrees.

6. The lighting apparatus of claim 4, wherein the lighting module is configured to be positioned and locked along the arc component in one or more of a range of user selected positions and the optic holder angle and position can be adjusted.

7. A downlight lighting apparatus, comprising:
- a housing having a top side opposing a bottom side, the bottom side having an aperture formed therein extending towards a cavity adapted to receive one or more lighting system components;
- a lighting module comprising:
  - a housing element; and
  - a lighting element;
- an adjustable arc assembly disposed within the cavity and connected to the bottom side of the housing at one or more points, the adjustable arc assembly comprising:
  - a ring-shaped turntable component; and
  - an arc component having a curved portion formed as a semi-circular structure and two base portions at each end of the semi-circular structure, each base portion extending outwardly with resect to a central axis of the arc component and connected to a platform element comprising a top platform plate opposing a bottom platform plate, wherein each platform plate is elongated and flat and has an interior face slidably engaged with the turntable component to enable stable rotation of the arc component along the turntable component and about a vertical axis of the housing and wherein a top face of each top platform plate comprises a rotation locking element configured to selectively lock the platform elements to the turntable component to selectively restrict rotation of the arc component;

a lighting driver assembly electronically connected to the lighting module; and a heat sink component.

8. The downlight lighting apparatus of claim 7, wherein the arc component is configured to rotate 360 degrees relative to a vertical axis of the turntable component.

9. The downlight lighting apparatus of claim 7, wherein the lighting module is configured to tilt 45 degrees in one or more directions and the lighting module can be positioned in different user selected positions along the arc component.

10. The downlight lighting apparatus of claim 7, wherein the rotation locking elements are configured to selectively lock the platform portions of the arc component along the turntable component in a user selected position over a range of 360 degrees.

11. The downlight lighting apparatus of claim 7, wherein the turntable component includes a collar configured to reversibly connect to a mudplate configured to reversibly connect to a trim.

12. The downlight lighting apparatus of claim 7, wherein the lighting module housing element is configured to reversibly receive the lighting element.

13. The down lighting apparatus of claim 1, wherein the arc component is formed with a curved track adapted to engage with a portion of the lighting module to enable movement of the lighting module along the arc component track.

14. The down lighting apparatus of claim 1, wherein the lighting module travels along the semi-circular structure 45 degrees in at least two directions relative to the housing aperture.

15. The lighting apparatus of claim 4, wherein the semi-circular shape of the arc component supports movement of the lighting module 45 degrees in two directions.

16. The lighting apparatus of claim 4, wherein movement of the turntable component and lighting module is automated and permits a user to adjust or change the degree of tilt or angle of the adjustable arc or the lighting module by use of a remote device.

17. The downlight lighting apparatus of claim 7, wherein the base portions of the arc component are substantially "L" shaped and provide access to the rotation locking elements of the platforms elements.

* * * * *